US011399643B2

(12) United States Patent
Jain

(10) Patent No.: US 11,399,643 B2
(45) Date of Patent: Aug. 2, 2022

(54) EXPANDABLE FITTED BED SHEET

(71) Applicant: INDO COUNT INDUSTRIES LTD., Mumbai (IN)

(72) Inventor: Mohit Kumar Jain, Mumbai (IN)

(73) Assignee: INDO COUNT INDUSTRIES, LTD., Mumbai (IN)

( * ) Notice: Subject to any disclaimer, the term of this patent is extended or adjusted under 35 U.S.C. 154(b) by 25 days.

(21) Appl. No.: 16/093,210

(22) PCT Filed: May 31, 2018

(86) PCT No.: PCT/IN2018/050350

§ 371 (c)(1),
(2) Date: Oct. 12, 2018

(87) PCT Pub. No.: WO2018/220649

PCT Pub. Date: Dec. 6, 2018

(65) Prior Publication Data

US 2021/0177167 A1 Jun. 17, 2021

(30) Foreign Application Priority Data

May 31, 2017 (IN) ..... 201721019135

(51) Int. Cl.
*A47G 9/02* (2006.01)
*A47G 9/04* (2006.01)

(52) U.S. Cl.
CPC ..... *A47G 9/0246* (2013.01); *A47G 9/04* (2013.01)

(58) Field of Classification Search
CPC ..... A47G 9/0246; A47G 9/04; A47G 9/02; A47G 9/0276; A47G 9/0328
See application file for complete search history.

(56) References Cited

U.S. PATENT DOCUMENTS

| | | | |
|---|---|---|---|
| 2,682,062 | A | 6/1954 | Cogan |
| 3,013,283 | A | 12/1961 | Steffinich |
| 5,029,353 | A | 7/1991 | Kimball et al. |
| 5,046,207 | A | 9/1991 | Chamberlain |
| 5,177,821 | A | 1/1993 | Kawtoski |
| 5,325,555 | A | 7/1994 | Whitley |
| 5,491,853 | A | 2/1996 | Turnbull |
| 5,530,979 | A | 7/1996 | Whitley |
| 5,625,912 | A | 5/1997 | McCain et al. |
| 5,996,148 | A | 12/1999 | McCain et al. |

(Continued)

FOREIGN PATENT DOCUMENTS

| | | | |
|---|---|---|---|
| CN | 105496110 | A | 4/2016 |
| DE | 19851391 | A1 | 7/1999 |
| WO | 2012030446 | A1 | 3/2012 |

*Primary Examiner* — Peter M. Cuomo
*Assistant Examiner* — Adam C Ortiz
(74) *Attorney, Agent, or Firm* — Gardner, Groff & Greenwald, PC

(57) ABSTRACT

An expandable fitted bed sheet for fitting with mattresses of different sizes. In example embodiments, the expandable fitted bed sheet is reconfigurable between an unzipped or enlarged configuration for fitting with a first mattress comprising a first mattress size and a zipped or reduced configuration for fitting with a second mattress comprising a second mattress size. At least one closure feature is provided for providing adjustability to the fitted bed sheet between the enlarged configuration and the reduced configuration.

14 Claims, 9 Drawing Sheets

(56) References Cited

U.S. PATENT DOCUMENTS

| | | | | |
|---|---|---|---|---|
| 6,453,492 | B1 | 9/2002 | Sturrock | |
| 6,842,921 | B1 | 1/2005 | Tsiarkezos et al. | |
| 7,240,383 | B2 | 7/2007 | Stewart | |
| 7,856,684 | B2 | 12/2010 | Robertson et al. | |
| 8,171,581 | B2 | 5/2012 | Agarwall | |
| 8,370,974 | B2 | 2/2013 | Caines | |
| 8,522,378 | B2 | 9/2013 | Argento | |
| 8,640,282 | B2 | 2/2014 | Maguire et al. | |
| 8,689,373 | B2 | 4/2014 | Caines | |
| 8,813,280 | B1 | 8/2014 | Arora | |
| 9,038,213 | B2 | 5/2015 | Cuneo | |
| 9,510,698 | B1 | 12/2016 | Krotova | |
| 2002/0088054 | A1 | 7/2002 | McCain et al. | |
| 2007/0050909 | A1 | 3/2007 | Coe | |
| 2008/0028522 | A1 | 2/2008 | Atwood | |
| 2009/0193584 | A1 | 8/2009 | Stewart et al. | |
| 2011/0023234 | A1 | 2/2011 | Bolish et al. | |
| 2012/0054962 | A1 | 3/2012 | Agarwall | |
| 2012/0255120 | A1* | 10/2012 | Poston ..... | A47C 31/105 5/499 |
| 2015/0026887 | A1 | 1/2015 | Taylor | |
| 2016/0081497 | A1 | 3/2016 | Keinigs | |

* cited by examiner

EXPANDABLE FITTED BED SHEET

TECHNICAL FIELD

The present invention relates generally to the field of fitted bed sheets, and more particularly to a fitted bed sheet having expandable sections to accommodate fitting mattresses of differing sizes.

BACKGROUND

Fitted bed sheets are commonly used for fitting around a mattress. Commonly, bed sheets are sized to only fit one mattress size, for example, where the mattress can be a twin, twin xl, full, queen, king and California king. As such, sheets must come in a plurality of different sizes to accommodate fitting with the plurality of different mattress sizes. Accordingly, it can be seen that needs exist for a fitted sheet capable of fitting with more than one mattress size. It is to the provision of an expandable fitted bed sheet meeting these and other needs that the present invention is primarily directed.

SUMMARY

In example embodiments, the present invention provides an expandable fitted bed sheet for fitting with mattresses of different sizes.

In one aspect, the present invention relates to an expandable fitted bed sheet that is reconfigurable between an unzipped or enlarged configuration for fitting with a first mattress having a first mattress size and a zipped or reduced configuration for fitting with a second mattress having a second mattress size. In example embodiments, a closure feature is provided at each corner of the sheet and comprises a pair of engagement members and a main zipping member.

According to one example embodiment, the first mattress includes a queen size mattress and the second mattress includes a full size mattress. Alternatively, the first mattress includes a California king size mattress and the second mattress includes a king size mattresses. Optionally, the first mattress includes a twin xl size mattress and the second mattress includes a twin size mattress.

In another aspect, the present invention relates to an expandable fitted bed sheet reconfigurable between an unzipped or enlarged configuration for fitting with a first mattress having a first mattress size and a zipped or reduced configuration for fitting with a second mattress having a second mattress size. A closure feature is provided at each corner of the sheet. The closure feature includes a pair of engagement members and a main zipping member.

In example embodiments, the closure feature includes a pair of engagement members extending adjacent each corner, and wherein an engaging member is movable along the engagement members to engage or disengage the engagement members such that the sheet is reconfigurable between the enlarged configuration or the reduced configuration. In example embodiments, the pair of engagement members include zipper teeth. In example embodiments, the first mattress includes a queen size mattress and the second mattress includes a full size mattress. In example embodiments, the closure features are substantially disengaged when the fitted bed sheet is fittingly engaged with the first mattress, and wherein the closure features are substantially engaged when the fitted bed sheet is fittingly engaged with the second mattress. In example embodiments, the fitted bed sheet has a length, a width, and side and end panels defining a depth, the length being between about 75-80 inches, the width being between about 54-60 inches, and the depth being between about 14-16 inches.

In yet another aspect, the present invention relates to fitted bed sheet reconfigurable for providing fitting engagement with dissimilar size mattresses, the fitted bed sheet including a top panel defining a length and a width, a pair side panels and end panels extending from the top panel to define an envelope for covering at least five sides of the mattresses, and at least one closure feature having engagement members, the engagement members providing adjustment to the size of the envelope thereof between a reduced configuration and an enlarged configuration, wherein the at least one closure feature is configured so as to provide at least about six inches of adjustment to the length and at least about six inches to the width.

In example embodiments, the at least one closure feature is provided at a corner portion where side portions of the side panels and end panels abut each other. In example embodiments, the fitted bed sheet further includes a closure feature at each corner portion, the closure feature being coupled in an asymmetric manner to so as to provide for adjustment to either the length or width of the fitted bed sheet. In example embodiments, a first pair of closure features provide for adjustment to the length of the envelope and wherein a second pair of closure features provide adjustment to the width of the envelope. In example embodiments, the dissimilar size mattresses comprise a king size mattress and a California king size mattress, and wherein the envelope has a length of between about 80-84 inches and a width of between about 72-78 inches. In example embodiments, the dissimilar size mattresses comprise a twin size mattress and a twin xl size mattress, and wherein the envelope has a length of between about 74-80 inches and a width of between about 38-40 inches. In example embodiments, the dissimilar size mattresses comprise a full size mattress and a queen size mattress, and wherein the envelope has a length of between about 75-80 inches and a width of between about 54-60 inches. In example embodiments, stitching is provided for securing side ends of the side panels with side ends of the end panels, and wherein the at least one closure feature is configured so as to couple along the stitching and with either one of the side panels or end panels so as to provide adjustment to either the length or width of the envelope.

In example embodiments, the fitted bed sheet further includes one or more elastic cords or members, the one or more elastic cords or members mounted to extend around either of the top panel or along edges of the side and end panels, or both. In example embodiments, at least one of the elastic members is a boxer elastic including one selected from the group consisting of a braided elastic, a knit elastic or a woven elastic.

In another aspect, the present invention relates to fitted bed sheet for providing fitting engagement with both a first mattress including a first mattress size and a second mattress including a second mattress size, the first and second mattresses being dissimilar in at least one of a length, a width and a depth, the fitted bed sheet including a top panel and oppositely opposing side and end panels, the side and end panels being generally stitched together to define an envelope for covering at least five sides of the first and second mattresses, wherein at least one or more closure features are provided such that the envelope can be reduced or expanded to provide for fitting engagement with both the first mattress and the second mattress.

In one example embodiment, the first mattress includes a twin size mattress having a length of about 74 inches, a width of about 39 inches, and a depth of about 14 inches, and wherein the second mattress includes a twin xl size mattress having a length of about 80 inches, a width of about 39 inches, and a depth of about 14 inches.

In another example embodiment, the first mattress includes a full size mattress having a length of about 75 inches, a width of about 54 inches, and a depth of about 14 inches, and wherein the second mattress includes a queen size mattress having a length of about 80 inches, a width of about 60 inches, and a depth of about 16 inches.

In yet another example embodiment, the first mattress includes a king size mattress having a length of about 80 inches, a width of about 78 inches, and a depth of about 16 inches, and wherein the second mattress includes a California king size mattress having a length of about 84 inches, a width of about 72 inches, and a depth of about 16 inches.

In yet another aspect, the present invention relates to a method of making a fitted sheet for fitting engagement with dissimilar mattress sizes. In example embodiments, the method includes providing a sheet material, cutting the sheet material to define a length and a width, cutting corners of the sheet material at a depth to define a pair of end panels and a pair of side panels, attaching the side ends of the end panels with the side ends of the side panels to define four corner portions, and attaching one or more closure features at the corner portions to permit expansion or retraction to the length and width of the fitted sheet.

According to one example embodiment, the closure features are attached to the panels in a symmetrical matter such that engagement/disengagement of the closure feature causes adjustment to both the length and width of the fitted sheet. According to another example embodiment, the closure features are attached to the panels such that engagement/disengagement of the closure feature causes adjustment to either the length or width of the fitted sheet.

These and other aspects, features and advantages of the invention will be understood with reference to the drawing figures and detailed description herein, and will be realized by means of the various elements and combinations particularly pointed out in the appended claims. It is to be understood that both the foregoing general description and the following brief description of the drawings and detailed description of example embodiments are explanatory of example embodiments of the invention, and are not restrictive of the invention, as claimed.

DETAILED DESCRIPTION OF EXAMPLE EMBODIMENTS

The present invention may be understood more readily by reference to the following detailed description of example embodiments taken in connection with the accompanying drawing figures, which form a part of this disclosure. It is to be understood that this invention is not limited to the specific devices, methods, conditions or parameters described and/or shown herein, and that the terminology used herein is for the purpose of describing particular embodiments by way of example only and is not intended to be limiting of the claimed invention. Any and all patents and other publications identified in this specification are incorporated by reference as though fully set forth herein.

Also, as used in the specification including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment.

Figures 1, 2:
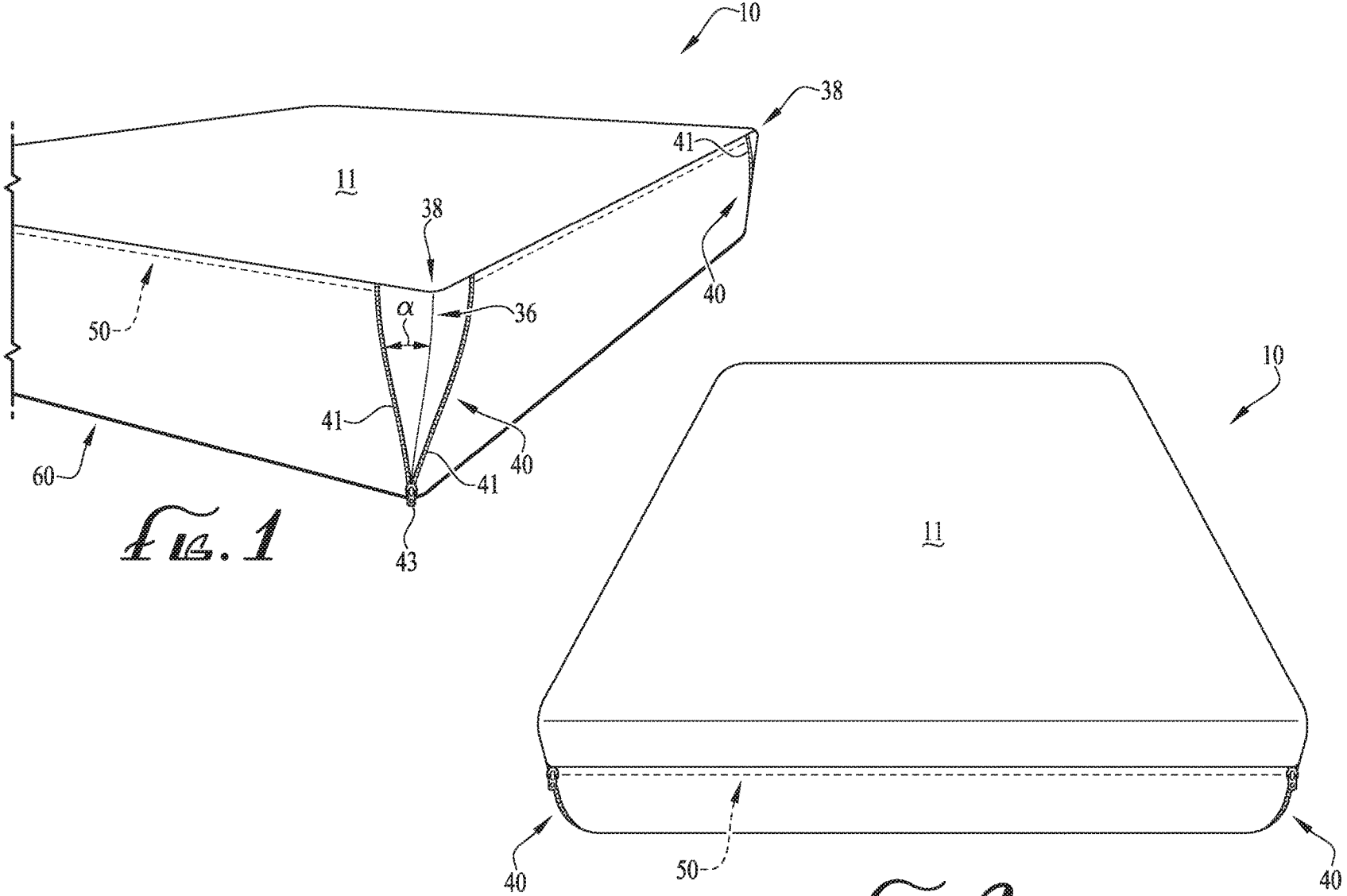
FIG. 1 is a perspective view of a fitted bed sheet according to an example embodiment of the present invention, showing the fitted bed sheet in an enlarged configuration and covering a first mattress size.
FIG. 2 is the fitted bed sheet of FIG. 1, showing the fitted bed sheet in a reduced configuration and covering a second mattress size.

With reference now to the drawing figures, wherein like reference numbers represent corresponding parts throughout the several views, FIGS. 1-2 show a fitted bed sheet 10 according to example embodiments of the present invention. In example embodiments, the fitted bed sheet 10 preferably can be fitted on mattresses of different sizes, for example, such that the fitted bed sheet 10 is expandable or reconfigurable between an unzipped or enlarged configuration (see FIG. 1) for fitting or covering a first mattress comprising a first mattress size and a zipped or reduced configuration (see FIG. 2) for fitting or covering a second mattress comprising a second mattress size.

In example embodiments, the fitted bed sheet 10 comprises expandable portions to accommodate fitting both the first and second mattresses, or for example, two other mattresses comprising different sizes. According to one example embodiment, the fitted bed sheet 10 is sized and adjustable to provide for fitting engagement with both twin size and twin xl size mattresses, with both full size and queen size mattresses, or with both king size and California king size mattresses. Accordingly, rather than commonly known fitted sheets only being sized for fitting one particular mattress size, the fitted bed sheet 10 of the present invention preferably provides for adjustability (e.g., expansion or retraction) to its size such that the fitted bed sheet 10 can be fitted or cover different size mattresses, for example, the first and second mattresses.

As depicted in FIG. 1, the sheet 10 is in the expanded configuration and a closure feature 40 is provided at each corner thereof. As shown, the closure feature 40 is substantially disengaged or open such that corner portions 38 thereof are permitted to fully extend outwardly and between portions of the closure feature 40, for example, to allow for fitting with the first mattress size. As depicted, FIG. 1 shows the sheet 10 fitted with a queen size mattress. In example embodiments, the sheet 10 covers the entirety of a top and sides (five total sides) of the mattress and at least a portion of the cover 10 generally extends to a bottom side of the mattress. Thus, the sheet 10 comprises an envelope or volume (e.g., a top panel 11 and side panels 26, 30) capable of receiving the first mattress of the first mattress size.

According to some example embodiments, one or more loops or other engagement features can be provided on portions of the sheet 10, for example, to facilitate further tight fitting engagement of the sheet 10 with the mattress by passing a rope, ribbon, fabric, elastic, or another elongate member through two or more of the loops or other rope-receiving members or openings of the sheet 10, and tightening the rope to draw the two or more loops closer together to further fittingly engage the sheet 10 with the mattress. According to other example embodiments, other fasteners, tensioners, clasps, straps, clips or other securing members can be provided for facilitating engagement of the sheet 10 with the mattress.

As depicted in FIG. 2, the sheet 10 is in the zipped or retracted configuration wherein the closure feature 40 is substantially engaged and closed such that the sheet 10 is configured for fitting engagement with the second size mattress, for example, a full size mattress according to one example embodiment. Accordingly, with the closure feature 40 closed, the corner portions 38 are prevented from extending between portions thereof, and thus the envelope of the sheet 10 or volume thereof to be fitted with the mattress becomes reduced to provide fitting engagement with the second mattress of the second size mattress (e.g., full size mattress according to the depicted embodiment).

Figure 3:
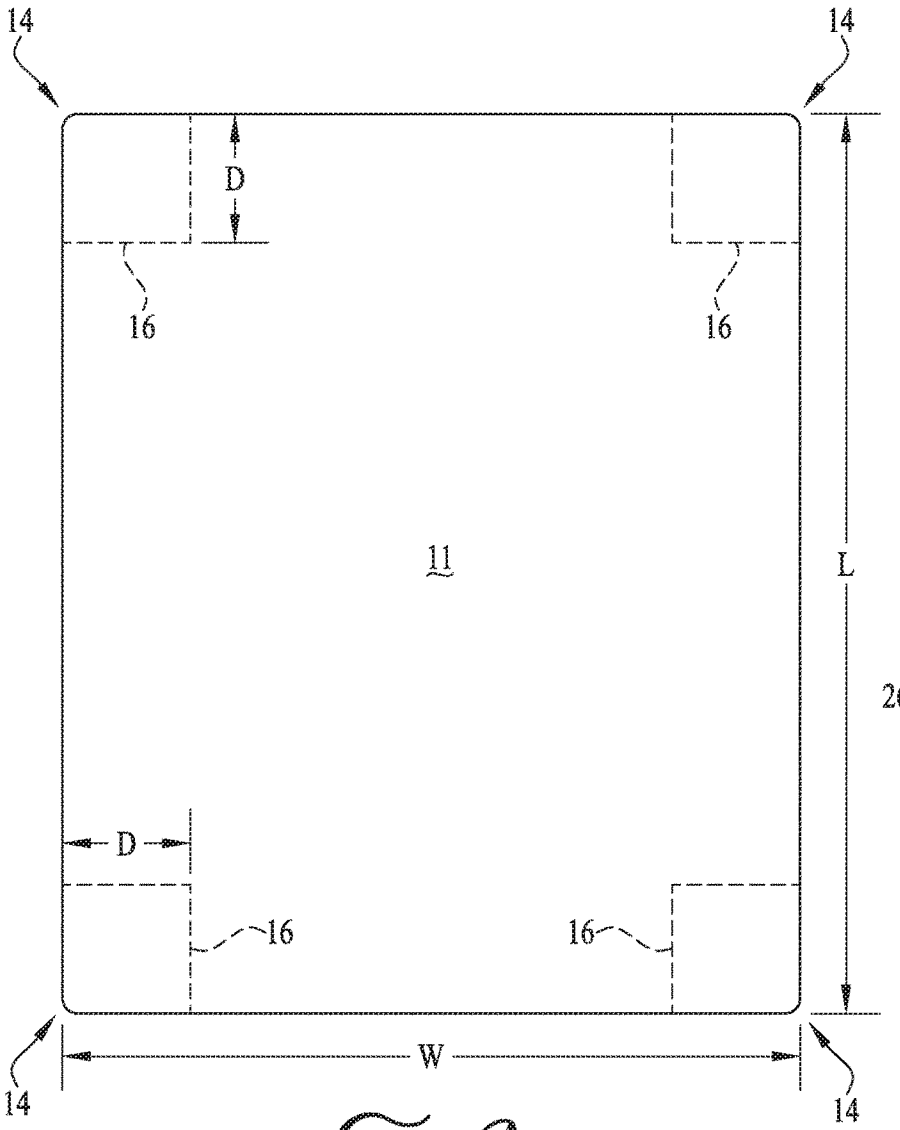

According to one example embodiment, a sheet, woven textile or fabric material 11 is provided or cut to a desired size, for example, comprising a length L and a width W (see FIG. 3). In example embodiments, the length L can be between about 100 inches to about 124 inches, for example between about 105-114 inches according to the depicted embodiment. The width W can be between about 69 inches to about 106 inches, for example between about 84-94 inches according to the depicted embodiment. Thus, according to the depicted example embodiment of FIG. 3, the length L and width W correspond to cut dimensions of the fabric material 11 for a queen size mattress. In example embodiments, the fabric material 11 is cut to generally define a rectangular sheet comprising four corners 14. Next, the corners of the fabric material 11 are cut along cutting lines 16 (at a depth D) such that each corner defines a notch or cutout 20 (see FIG. 4). In example embodiments, the depth D is generally between about 14-20 inches. In the depicted embodiment, the cutting lines 16 generally extend to define a depth D of about 16 inches from each side of the fabric material 11 such that a 16 inch by 16 inch cutout 20 at each corner of the fabric material 11. Optionally, according to additional example embodiments of the present invention, the length L is generally between about 95 inches to about 135 inches and the width W is generally between about 60 inches to about 120 inches.

Figure 4:
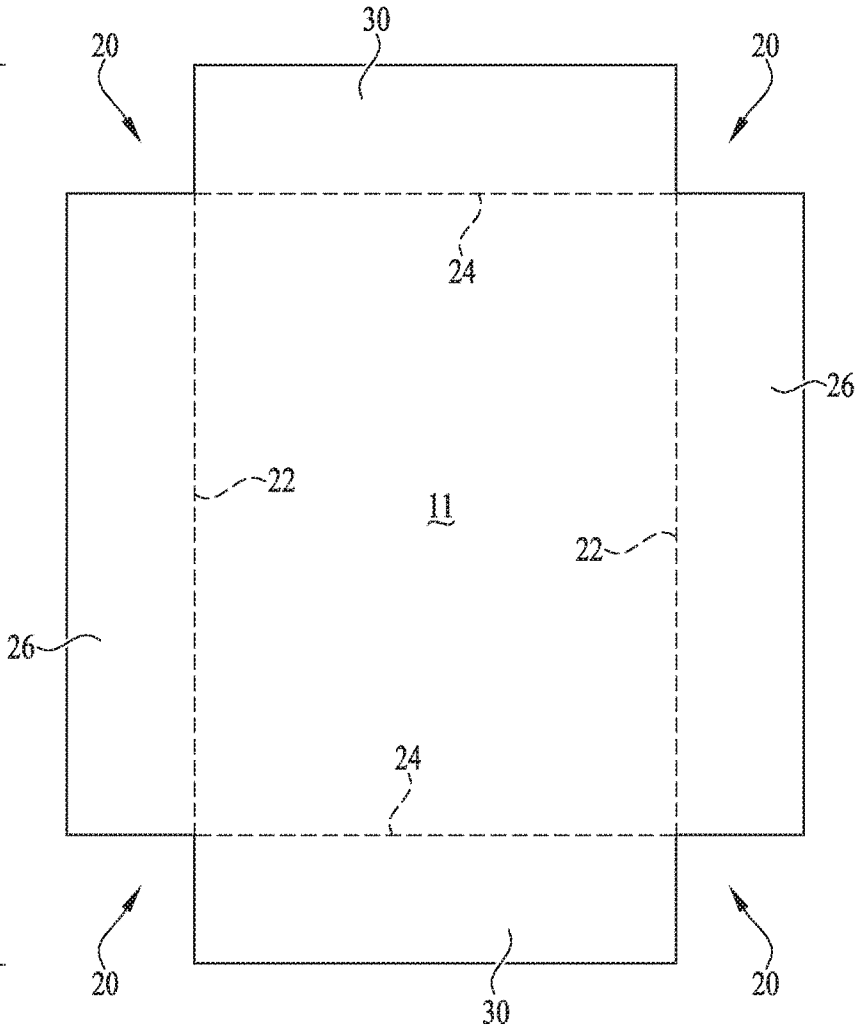
FIGS. 3-6 show a method of manufacturing an expandable fitted bed sheet according to an example embodiment of the present invention.
Figure 5:
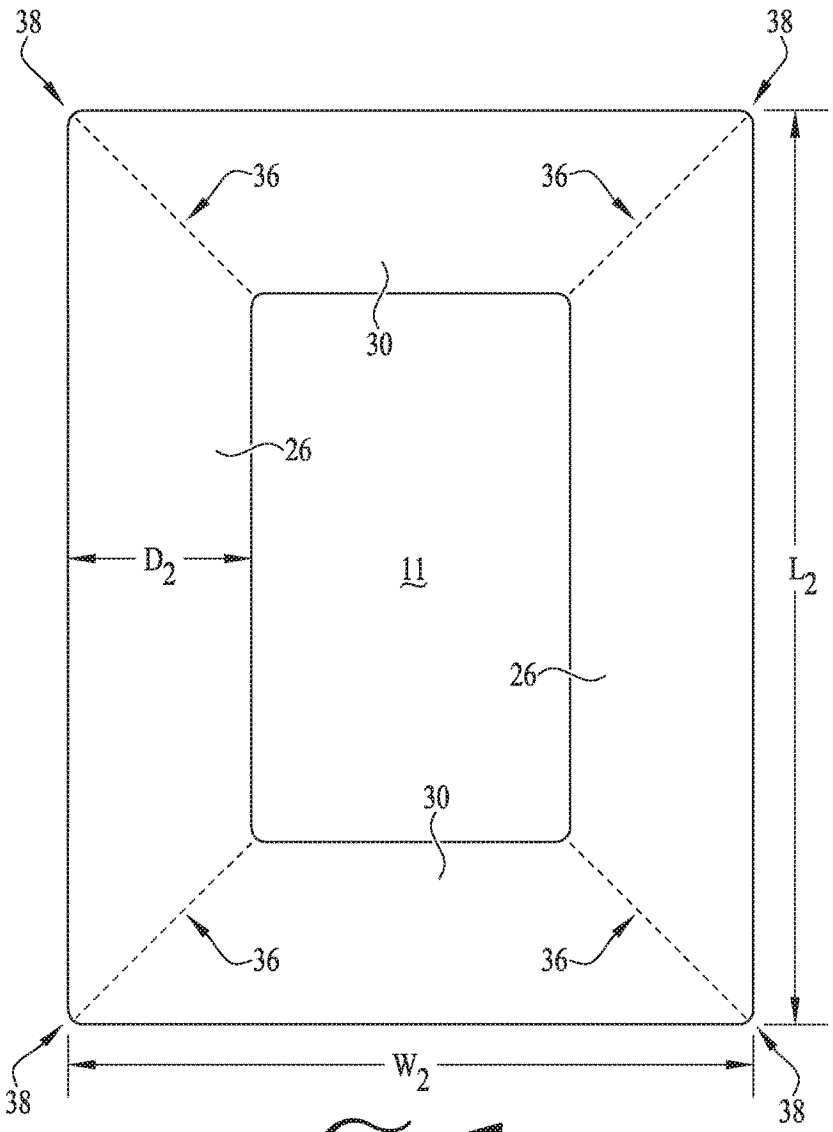

Next, as depicted in FIGS. 4-5, side panels 26 and end panels 30 are then folded along fold lines 22, 24 about 90 degrees, and ends of the panels 26, 30 are coupled or stitched together. In example embodiments, ends of the side panels 26 are stitched with stitching 36 to the ends of the end panels 30 (see FIG. 5). Optionally, the ends of the panels 26, 30 can be attached together as desired, for example with adhesive, coupling features or other permanent or removable couplings. According to example embodiments, by the stitching of the ends of the panels 26, 30, the fabric material 11 defines corners 38 and defines a length L2 and a width W2. In example embodiments, the length L2 is between about 75-80 inches and the width W2 is between about 54-60 inches (see FIG. 5). According to another example embodiment, the length L2 is between about 74-84 inches and the width W2 is between about 39-78 inches. Optionally, according to additional example embodiments, the length L2 is generally between about 65 inches to about 115 inches and the width W2 is generally between about 32 inches to about 90 inches. According to example embodiments, the depth of the panels 26, 30 can preferably be between about 5 inches to about 30 inches, for example, to provide for proper fitting engagement regardless of the thickness of the mattress.

Figure 6:
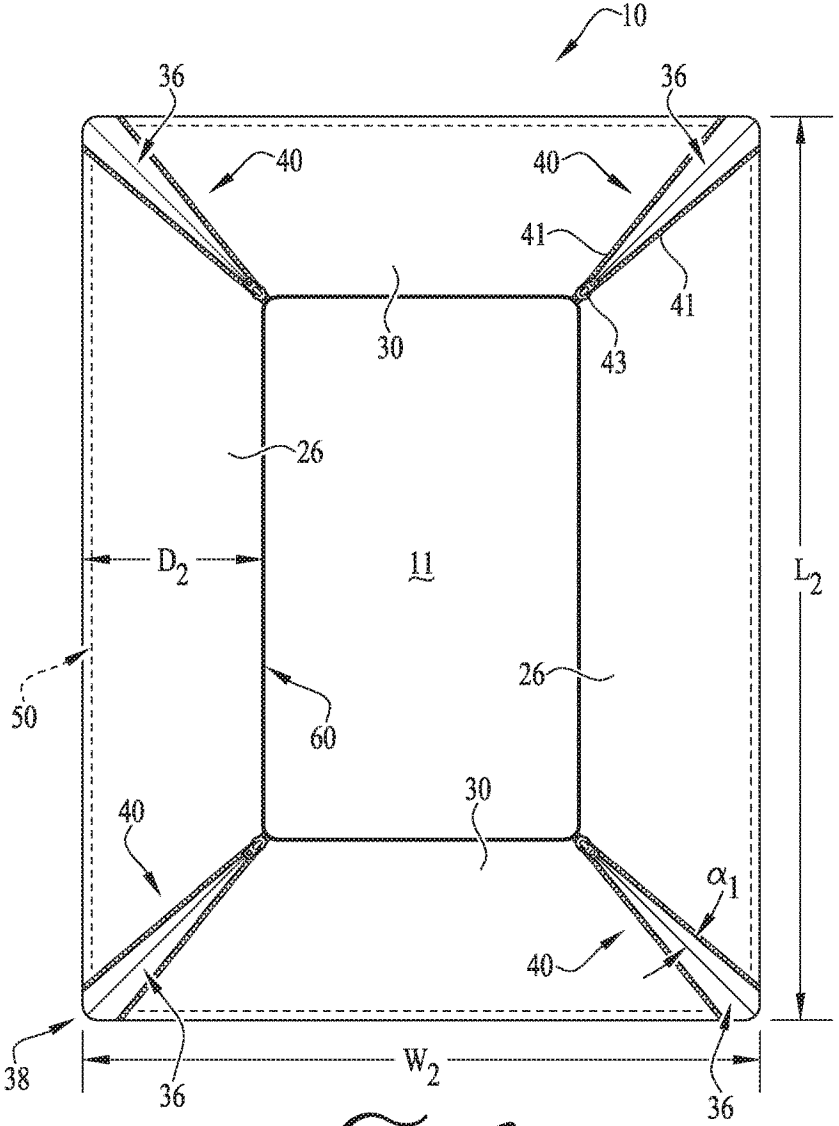

Next, the closure feature 40 is attached at each of the four corners 30. For example, as depicted in FIG. 6, each of the four corners 38 comprises a pair of engagement members or zipper teeth 41 that are generally angled relative to the stitching 36 and a main engaging or zipping member 43 is movable along the teeth 41 to engage or disengage the teeth 41 from each other. In example embodiments, the teeth 41 are generally attached to the panels 26, 30 such that an angle $\alpha_1$ is defined between each individual engagement member 41 and the stitching 36. In example embodiments, the angle $\alpha_1$ is generally between about 5-15 degrees. Optionally, other types of engagement members, hook and loop material, buttons, clasps, clips, other coupling members, etc. can be used rather than the zipper teeth 41, for example, to provide for the reduction or expansion of the corners of the sheet 10, for example, to adjust its size depending on the mattress size the sheet 10 is intended to be fitted with. According to example embodiments, the zipper teeth 41 are generally angled relatively similarly with respect to the stitching (e.g., at an angle $\alpha_1$), for example, to provide generally symmetrical closures at the corners. For example, with each of the zipper teeth 41 extending at a substantially similar angle $\alpha_1$ with respect to the stitching 36, a substantially similar amount of fabric material 11 is taken from the length L2 and width W2 thereof when in the zipped or reduced configuration in comparison to the unzipped or enlarged configuration.

Figure 7:
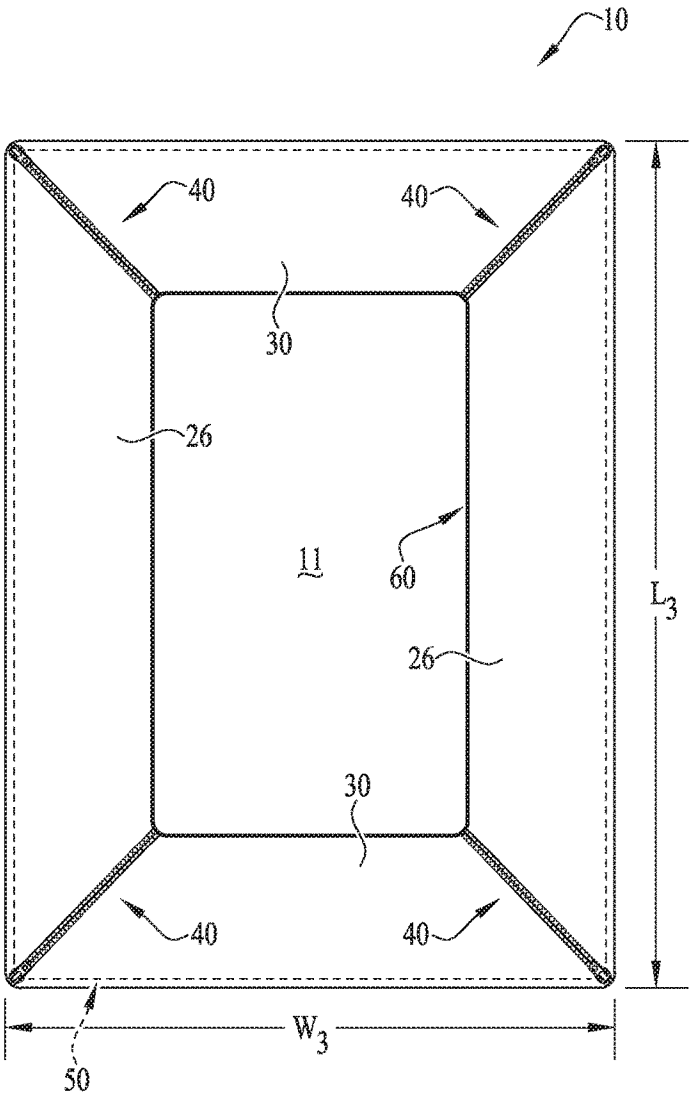
FIG. 7 shows a plan view of the fitted bed sheet of FIG. 2, wherein the fitted bed sheet is in a reduced configuration for fitting with the second mattress size.

In example embodiments and as depicted in FIGS. 6-7, elastic members can be added to the fabric material as desired, for example, to ensure the sheet 10 provides a snug fit with the mattress or a mattress pad that is fitted atop the mattress. In example embodiments, a first elastic cord or member 50 is attached to extend around a top panel portion of the fabric material 11, and a second elastic material or boxer elastic 60 is attached/stitched to and extending along the edges of the panels 26, 30. In example embodiments, the elastic members 50, 60 preferably provide elasticity to the fabric material 11, for example, to provide for fitting engagement with the first and second mattress (or a mattress pad fitted on the mattress). According to one example embodiment, the first elastic member 50 is generally stitched to a portion of the sheet, for example, generally between the top panel 11 and the side panels 26, 30 around substantially the entire periphery thereof. In example embodiments, the first elastic member 50 comprises a width of about 0.16 inches. Optionally, the width or dimension of the first elastic member 50 (and elasticity thereof) can be chosen as desired. According to example embodiments and as depicted in FIGS. 1 and 6, the first elastic member 50 is stitched along the length L2 and width W2 (generally adjacent the intersection of the top panel 11 and side panels 26, 30) of the sheet except for along the sheet material that is defined between the closure features 40. However, according to other example embodiments of the present invention, the elastic member 50 can be stitched to the sheet material along the entire periphery thereof for example so as to be provided along the sheet material that is between the closure features 40. According to example embodiments of the present invention, the boxer elastic 60 comprises a width of about one inch. Optionally, the boxer elastic can comprise a width that is less than or greater than one inch. For example, according to one example embodiment, the boxer elastic 60 comprises a width of about 0.16 inches (e.g., about 4 millimeters). According to some example embodiments, the boxer elastic can comprise one of a braided elastic, a knit elastic or a woven elastic. Optionally, other elastics can be chosen as desired.

In example embodiments and as described above, the sheet 10 can be configured for a zipped or reduced configuration wherein the sheet 10 is provided for fitting with a second mattress comprising a second mattress size (see FIGS. 2 and 7), or can be configured for an unzipped or enlarged configuration for fitting with a first mattress comprising a first mattress size (see FIGS. 1 and 6). According to one example embodiment and as depicted in FIG. 7, the sheet 10 comprises a length L3 and a width W3 when in the zipped or reduced configuration. For example, according to one example embodiment, the length L3 is about 75 inches and the width W3 is about 54 inches. Optionally, the length and width L3, W3 can be varied as desired, for example, to provide a sufficient fit with the intended mattress size. And as described above, FIG. 6 shows the sheet 10 in an unzipped or enlarged configuration comprising the length L2 and a width W2 to provide for proper fitting engagement with the first mattress comprising the first mattress size. According to one example embodiment, the length L2 is about 80 inches and the width W2 is about 60 inches. Thus, according to one example embodiment, the sheet 10 is reconfigurable to provide for fitting engagement with a queen size mattress (see FIGS. 1 and 6) and a full size mattress (see FIGS. 2 and 7).

In example embodiments, as described above, the sheet 10 can preferably be reconfigurable to provide for fitting engagement with at least two different mattress sizes. In example embodiments, the first mattress comprises a queen size mattress and the second mattress comprises a full size mattress. In another example embodiment, the first mattress comprises a California king size mattress and the second mattress comprises a king size mattress. According to another example embodiment, the first mattress comprises a twin xl size mattress and the second mattress comprises a twin size mattress.

Figure 9:
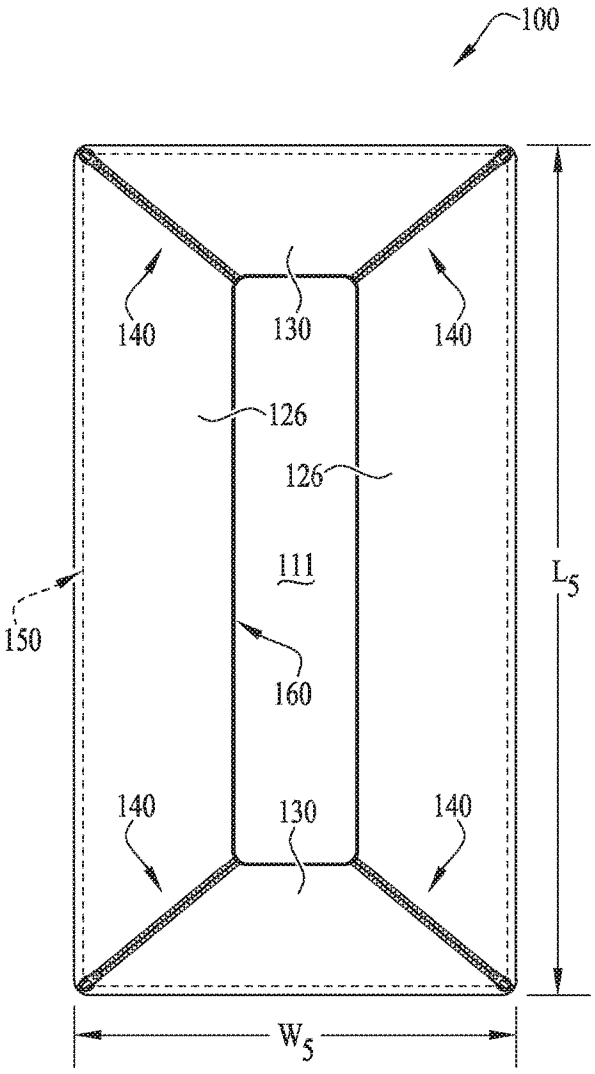
FIG. 9 shows a plan view of the fitted bed sheet of FIG. 8, wherein the fitted bed sheet is in a reduced configuration for fitting with a fourth mattress size.
Figure 8:
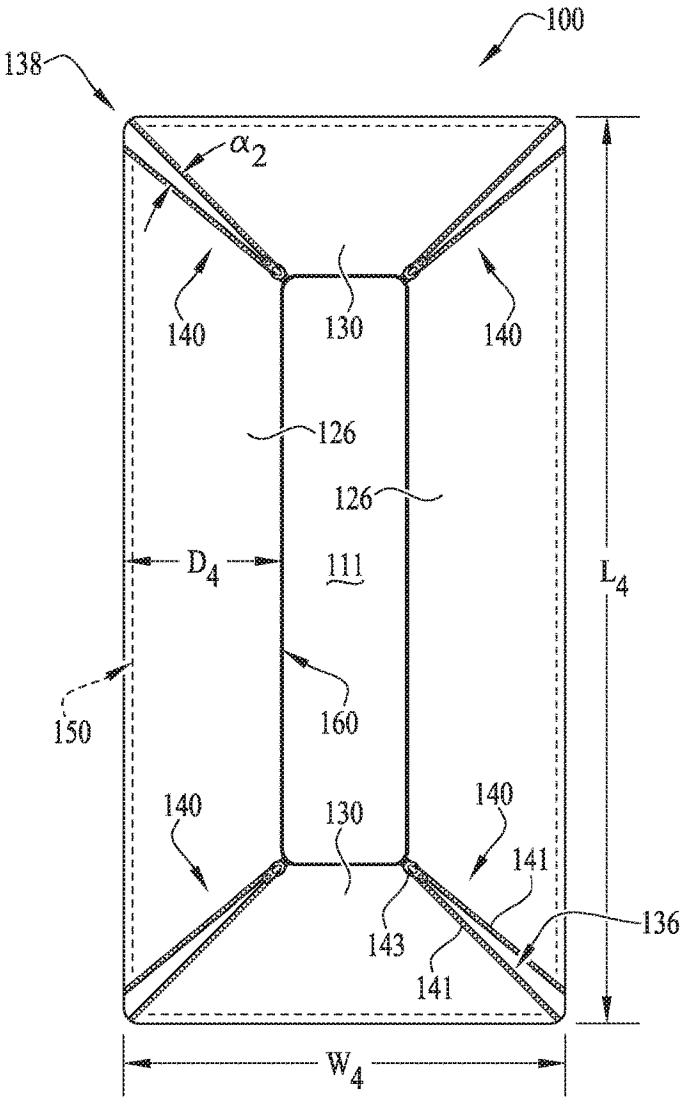
FIG. 8 shows a plan view of the fitted bed sheet according to another example embodiment of the present invention, wherein the fitted bed sheet is in an enlarged configuration for fitting with a third mattress size.

For example, FIGS. 8-9 show a sheet 100 according to another example embodiment of the present invention. In example embodiments, the sheet 100 is preferably reconfigurable to provide for fitting engagement with both a twin xl size mattress (see FIG. 8) and a twin size mattress (see FIG. 9). In example embodiments, the sheet 100 is generally similar to the sheet 10 as described above, for example, comprising a top panel 111, side panels 126, end panels 130, corner portions 138, and closure features 140. Furthermore, the sheet 100 can comprise a first elastic cord or member 150 and a second elastic material or boxer elastic 160 as described above.

In example embodiments, the sheet 100 comprises a closure feature 140 at each of the four corner portions 138. In example embodiments, each of the four closure features 140 are configured to permit expansion or retraction of the length L4 of the sheet 100, for example, to provide for fitting engagement with either of a twin size mattress or a twin xl size mattress. As depicted in FIG. 8, each of the closure features 140 comprises a pair of engagement members or zipper teeth 141 defining an angle $\alpha_2$ therebetween, for example, which is attached to the drop or side panels 126 and a corner seam or stitching 136. Thus, in example embodiments, with zipper teeth 141 coupled to the stitching 136 and to the side panels 126 (and angled relative to each other to define the angle $\alpha_2$), movement of the main engaging or zipping member 143 along the length of the zipper teeth 141 provides for expansion or retraction to the length L4 of the sheet 100. According to the depicted example embodiment, the length L4 is generally about 80 inches, the width W4 is generally about 39 inches, the depth D4 is generally about 14 inches, and the angle $\alpha_2$ is generally between about 2-15 degrees.

As depicted in FIG. 9, the sheet 100 is in the retracted configuration for providing fitting engagement with a twin size mattress, for example, to define a length L5 and a width W5. In example embodiments, the length L5 is generally about 75 inches and the width W5 is generally about 39 inches. Thus, in comparison to the sheet 100 in the expanded configuration (see FIG. 8), engagement of the closure feature 140 reduces the length of the sheet 100 from 80 inches (see L4) to 75 inches (see L5). Accordingly, each of the closure features 140 preferably provide for about 2.5 inches in adjustment to the length of the sheet 100. However, as the closure feature 140 (and zipper teeth 141) are coupled to the side panels 126 and stitching 136, engagement or disengagement of the zipper teeth 141 generally does not change the width of the sheet 100. Thus, according to example embodiments, the sheet 100 is configured such that the closure features 140 can provide adjustment to the length of the sheet while maintaining the same width.

Figure 10:
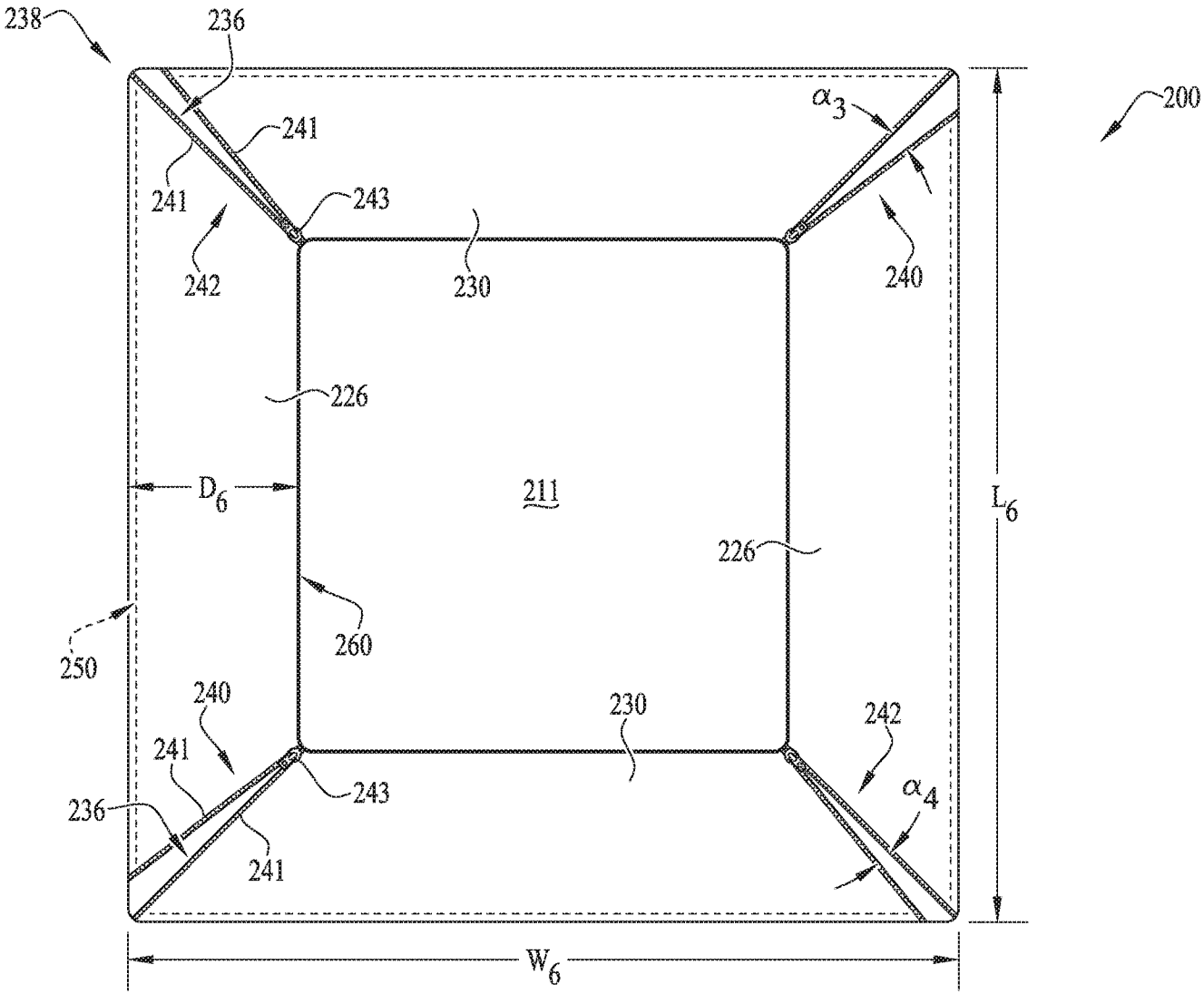
FIG. 10 shows a plan view of a fitted bed sheet according to another example embodiment of the present invention.
Figure 11:
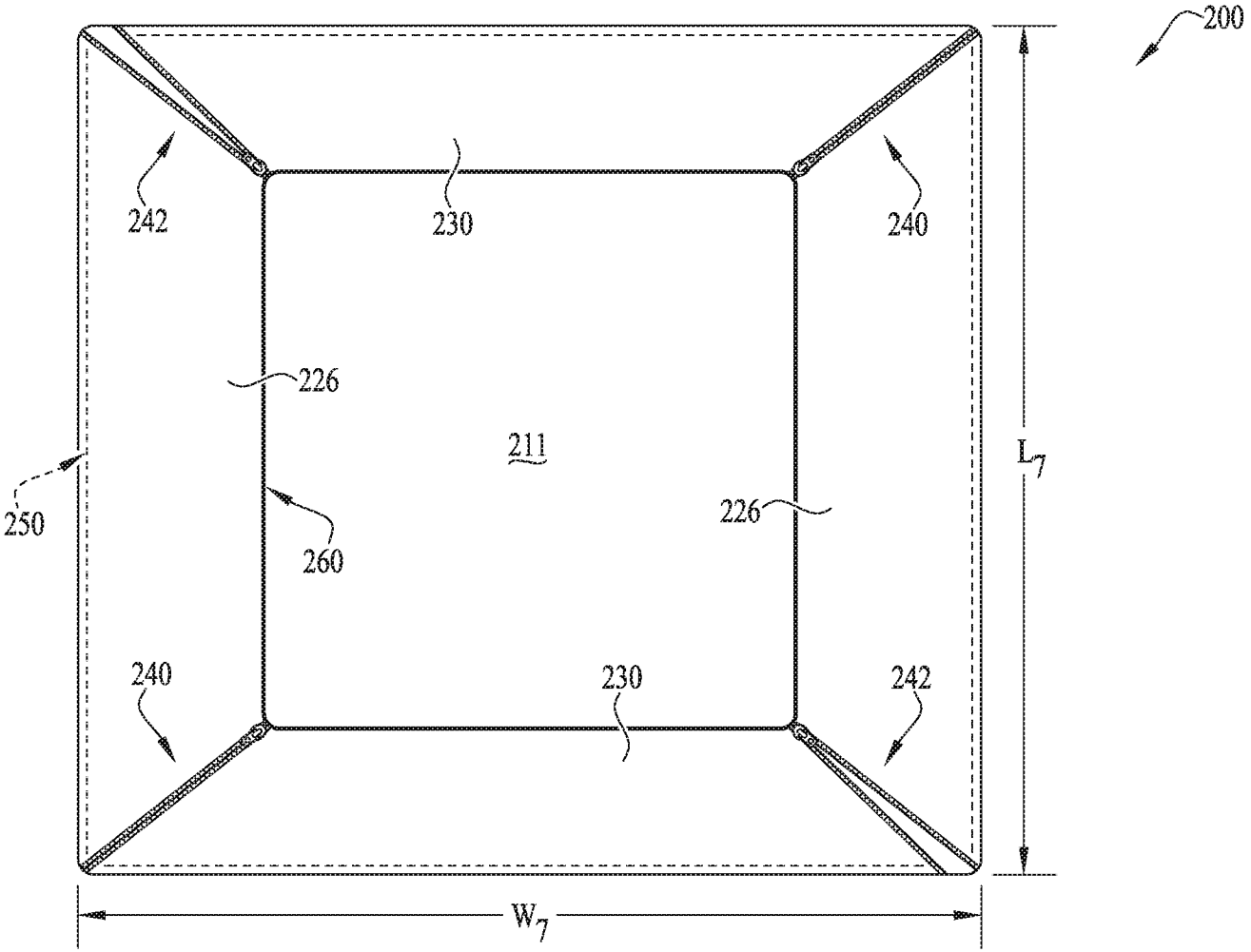
FIG. 11 shows a plan view of the fitted bed sheet of FIG. 10, wherein the fitted bed sheet is in a first reduced configuration for fitting with a fifth mattress size.
Figure 12:
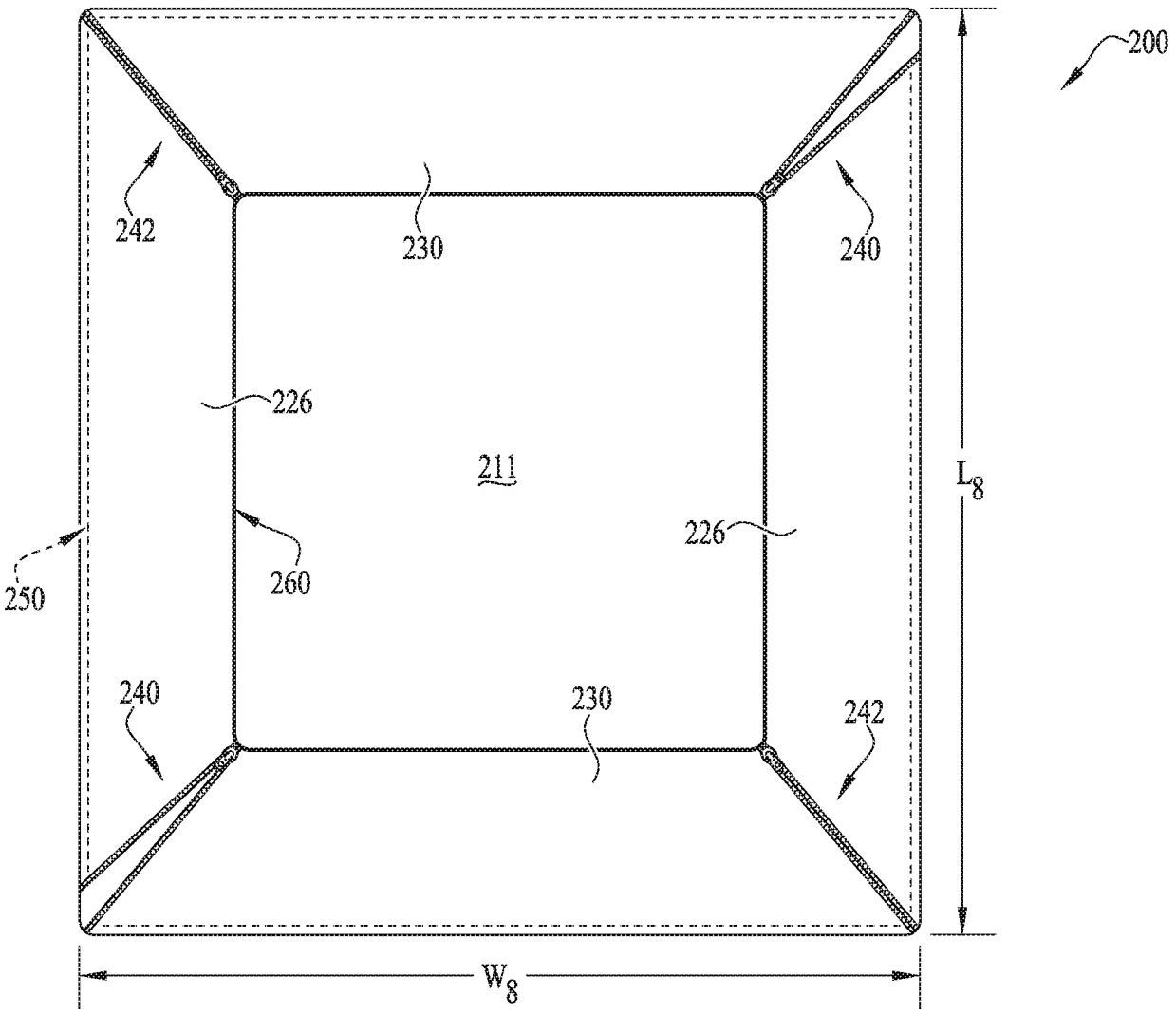
FIG. 12 shows a plan view of the fitted bed sheet of FIG. 10, wherein the fitted bed sheet is in a second reduced configuration for fitting with a sixth mattress size.

According to another example embodiment of the present invention, the sheet can be reconfigurable to provide for fitting engagement with both a king size mattress and a California king size mattress. For example, FIGS. 10-12 show a sheet 200 that is generally similar to the sheets 10, 100 as described above, for example, comprising a top panel 211, side panels 226, end panels 230, corner portions 238, and closure features 240, 242. In some example embodiments, the sheet 200 comprises a first elastic cord or member 250 and a second elastic material or boxer elastic 260 as described above.

In example embodiments, the sheet 200 comprises a closure feature at each of the four corner portions 238, for example, a first pair of closure features 240 and a second pair of closure features 242. The first pair of closure features 240 are positioned so as to be at opposite corners of the sheet 200, and similarly the second pair of closure features 242 are positioned at the remaining two corners of the sheet 200, for example, which are similarly opposite from each other. In example embodiments, each of the four closure features 240, 242 are configured to permit expansion or retraction of the sheet 200, for example, to provide for fitting engagement with either of a king size mattress or a California king size mattress. As depicted in FIG. 10, the closure features 240, 242 comprise a pair of engagement members or zipper teeth 241 as similarly described above and a main engaging or zipping member 243 that is movable along the zipper teeth 241 so as to cause engagement or disengagement of the zipper teeth 241, for example, to permit fitting engagement with both the king size mattress and a California king size mattress.

As depicted in FIG. 10, the closure features 240, 242 are in the open, expanded or disengaged configuration such that the sheet 200 defines a length L6 and a width W6. The depth D6 of the side panels 226, 230 is substantially constant regardless of whether the closure features 240, 242 are engaged or disengaged. In example embodiments, the length L6 is about 84 inches, the width W6 is about 78 inches, and the depth D6 is about 16 inches. According to example embodiments, the closure features 240 are provided on two of the four corners of the sheet 200 to permit expansion or retraction of the length L6 of the sheet 200 and the closure features 242 are provided on the other two corners of the sheet 200 to permit expansion or retraction of the width W6 of the sheet 200. In the depicted example embodiment, for example, the closure features 240 are provided at a bottom left and top right corner of the sheet 200, and the closure features 242 are provided at a bottom right and top left corner of the sheet 200. In example embodiments, rather than the closure features only permitting expansion or retraction of the length of the sheet (as depicted in FIGS. 8-9), the closure features 240, 242 are configured so as to provide selective expansion or retraction of either the length, the width, or both the length and the width of the sheet 200.

For example, the closure features 240 are positioned at opposite corners of the sheet 200 and comprise a pair of engagement members or zipper teeth 241 defining an angle $\alpha_3$ therebetween, for example, which is attached to the drop or side panels 226 and a corner seam or stitching 236. Thus, in example embodiments, with zipper teeth 241 coupled to the stitching 236 and to the side panels 126 (and angled relative to each other to define the angle $\alpha_3$), movement of the main engaging or zipping member 243 along the length of the zipper teeth 241 provides for expansion or retraction to the length L6 of the sheet 200. Closure features 242 comprise a pair of zipper teeth 241 coupled to the drop or end panels 230 and a corner seam or stitching 236. Thus, with the zipper teeth 241 coupled to the stitching 236 and to the end panels 230 (and angled relative to each other to define an angle $\alpha_4$), movement of the main engaging or zipping member 243 along the length of the zipper teeth 241 provides for expansion or retraction to the width W6 of the sheet 200. According to example embodiments of the present invention, the angle $\alpha_3$ is generally between about 5-35 degrees and the angle $\alpha_4$ is generally between about 2-30 degrees. For example, as the length L6 of the sheet can be reduced by about 4 inches and the width W6 can be reduced by about 6 inches, the angle $\alpha_3$ need not be as large as the angle $\alpha_4$. However, according to alternate example embodiments, the angles $\alpha_3$, $\alpha_4$ can be configured as desired. According to additional example embodiments of the present invention, the angles $\alpha_3$, $\alpha_4$ can preferably be configured so as to provide between about 1-6 inches in adjustment to the length L6 of the sheet and between about 1-8 inches in adjustment to the width W6 of the sheet.

According to example embodiments, when the sheet 200 is configured for engagement with the king size mattress, the closure features 240 are in the closed or engaged configuration and the closure features 242 are in the open or expanded configuration (see FIG. 11). Thus, engagement of the zipper teeth 241 of the closure features 240 is such that the length is reduced from about 84 inches (see L6) to a length L7 of about 80 inches (while the width W7 remains about 78 inches). Accordingly, the closure features 240 preferably provide for a reduction of about 4 inches to the length of the sheet 200. Optionally, as described above, the closure features 240 can be configured to provide a reduction of between about 1-6 inches. According to another example embodiment, to provide for fitting engagement of the sheet 200 with the California king size mattress, the closure features 240 are in the open or expanded configuration and the closure features 242 are in the closed or engaged configuration (see FIG. 12). Thus, engagement of the zipper teeth 241 of the closure features 242 is such that the width is reduced from about 78 inches (see W6) to a width W8 of about 72 inches. Accordingly, the closure features 242 preferably provide for a reduction of about 6 inches to the width of the sheet 200, for example, about 3 inches of adjustment per closure feature 242 so as to define a length L8 of about 84 inches and a width W8 of about 72 inches. Optionally, as described above, the closure features 242 can be configured to provide a reduction of between about 1-8 inches.

Figure 13:
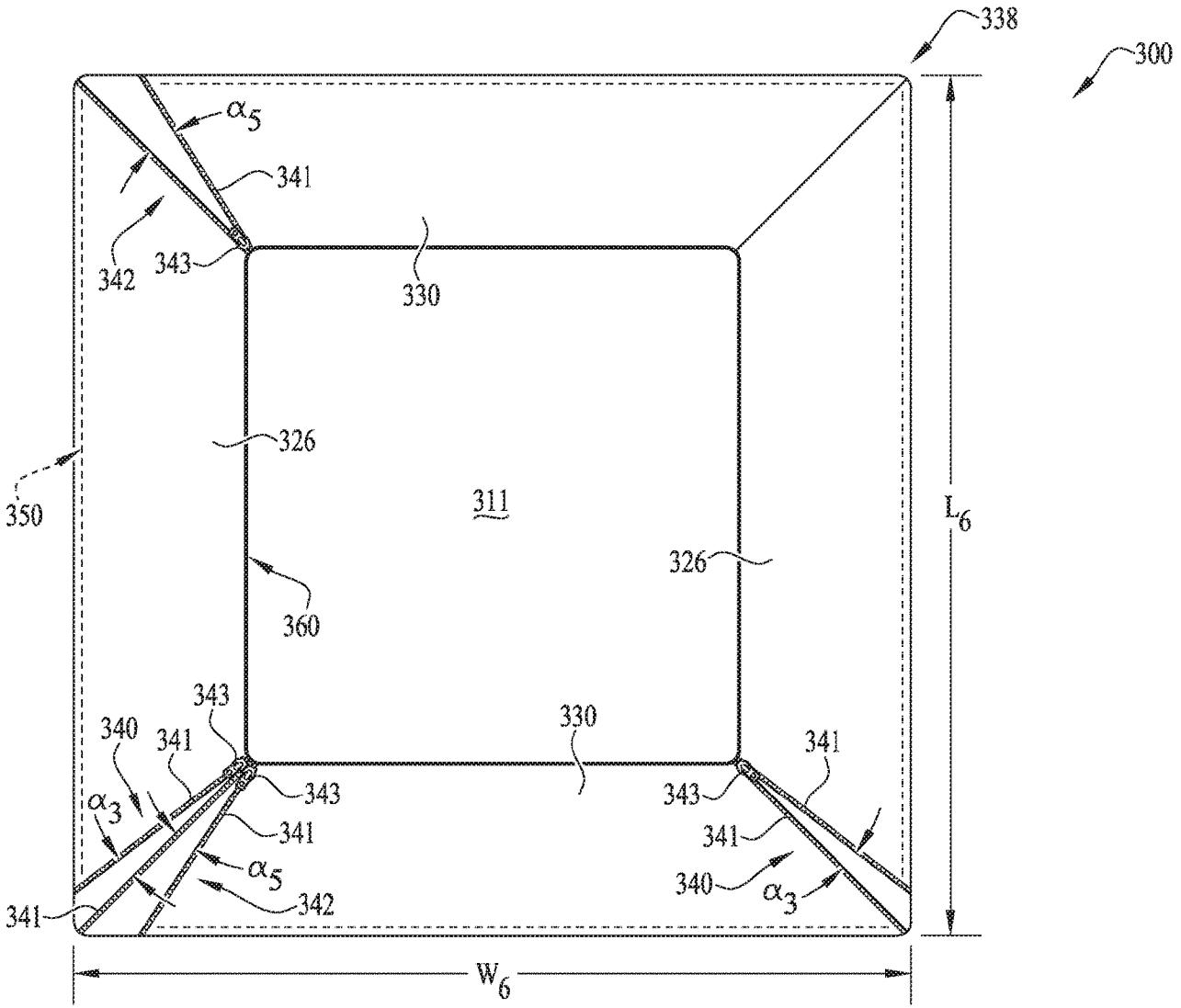
FIG. 13 shows a plan view of a fitted bed sheet according to another example embodiment of the present invention.

FIG. 13 shows a fitted bed sheet 300 according to another example embodiment of the present invention. As depicted, the fitted bed sheet 300 is generally similar to the fitted bed sheet 200 as described above, for example, comprising a length L6, a width W6, side panels 326, end panels 330, corner portions 338, and closure features 340, 342. According to example embodiments, rather than providing closure features at each of the corner portions as depicted in FIG. 10, the fitted bed sheet 300 comprises another arrangement of closure features such that the length L6 and/or width W6 can be adjusted as desired.

In example embodiments, one of the corner portions 338 comprises two closure features, for example, a first closure feature 340 and a second closure feature 342. The closure features 340, 342 can preferably operate independent of each other, for example, wherein closure of the closure feature 340 causes a reduction in the length L6 and closure of the closure feature 342 causes a reduction in the width W6. Preferably, the corner portions 338 adjacent to the corner portion 338 comprising the first and second closure features 340, 342 also comprise closure features. For example, one of the corner portions 338 comprises a closure feature 340, for example, which is provided for adjustment to the length L6, and the other corner portion 338 comprises a closure feature 342 so as to provide adjustment to the width W6. Thus, according to example embodiments, the fitted bed sheet 300 comprises a total of four closure features wherein two of the closure features (which are independently operable) are provided at one of the corner portions 338, and a single closure feature is provided at adjacent corner portions 338. So, according to some example embodiments, at least one of the corner portions 338 does not comprise a closure feature. According to example embodiments, the fitted bed sheet 300 can be reconfigurable between a first configuration for fitting engagement with a king size mattress (e.g., where the closure features 340 are engaged and the closure features 342 are disengaged) and a second configuration for fitting engagement with a California king size mattress (e.g., wherein the closure features 342 are engaged and the closure features 340 are disengaged).

According to example embodiments, the sheets 10, 100, 200 as described herein can preferably provide for fitting engagement with mattresses of dissimilar sizes, for example, a fitted sheet configured for fitting engagement with both a full size mattress and a queen size mattress (see sheet 10), a fitted sheet for fitting engagement with both a twin size mattress and a twin xl size mattress (see sheet 100), and a fitted sheet for fitting engagement with both a king size mattress and a California king size mattress (see sheet 200). Accordingly, rather than requiring a fitted sheet sized specifically to each mattress size (e.g., twin, twin xl, full, queen, king and California king), the sheets 10, 100, 200 of the present invention are configured so as to provide fitting engagement with mattresses of dissimilar sizes.

According to another example embodiment, the present invention relates to a method of making a fitted sheet for fitting engagement with dissimilar mattress sizes. In example embodiments, the method comprises providing a sheet material, cutting the sheet material to define a length and a width, cutting corners of the sheet material at a depth to define a pair of end panels and a pair of side panels, attaching the side ends of the end panels with the side ends of the side panels to define four corner portions, and attaching one or more closure features at the corner portions to permit expansion or retraction to the length and width of the fitted sheet. According to some example embodiments, the closure features are attached to the panels in a symmetrical matter such that engagement/disengagement of the closure feature causes adjustment to both the length and width of the fitted sheet. According to other example embodiments, the closure features are attached to the panels such that engagement/disengagement of the closure feature causes adjustment to either the length or width of the fitted sheet.

In example embodiments, the closure feature generally comprises a pair of zipper teeth that are generally angled relative to each other such that the zipping member is movable along the zipper to cause engagement or disengagement of the zipper teeth. According to one example embodiment, the zipper teeth and zipping member are preferably concealable and relatively discrete, for example, such that the closure feature is not noticeable and the fitted sheet appears to be constructed substantially similarly to a traditional fitted sheet. According to other example embodiments, other engagement members, claps, clips, fasteners, engagement members or other couplings can be alternatively provided at the corner portions of the fitted sheet to provide for similar expansion or retraction.

While the invention has been described with reference to example embodiments, it will be understood by those skilled in the art that a variety of modifications, additions and deletions are within the scope of the invention, as defined by the following claims.

What is claimed is:

1. An expandable fitted bed sheet comprising:

a top panel;

a pair of side panels with opposing ends distal from the top panel; and a pair of end panels with opposing end distal from the top panel, wherein the ends of the side panels are stitched to the ends of the ends of the end panels forming corners, each corner comprising a closure feature secured thereto, the closure feature comprising a pair of engagement members and an engaging member, wherein the fitted bed sheet is reconfigurable between a first configuration for fitting with a first mattress comprising a first mattress size and a second configuration for fitting with a second mattress comprising a second mattress size different from the first mattress size, and wherein the closure feature is disengaged in the first configuration and the closure feature is engaged in the second configuration.

2. The expandable fitted bed sheet of claim 1, wherein the closure feature is a zipper and the sheet is reconfigurable between a first unzipped configuration and a second zipped configuration.

3. The expandable fitted bed sheet of claim 1, wherein the first mattress comprises a queen size mattress and the second mattress comprises a full size mattress.

4. The expandable fitted bed sheet of claim 1, wherein the fitted bed sheet comprises a length, a width, and a depth defined by the side and end panels, wherein the length is adjustable between about 75-80 inches, the width is adjustable between about 54-60 inches, and the depth is adjustable between about 14-16 inches.

5. The expandable fitted bed sheet of claim 1, wherein the closure feature is coupled in an asymmetric manner so as to provide for adjustment to either a length or width of the fitted bed sheet.

6. The expandable fitted bed sheet of claim 1, wherein a first pair of closure features provide for adjustment to a length of the fitted bed sheet and wherein a second pair of closure features provide adjustment to a width of the fitted bed sheet.

7. The expandable fitted bed sheet of claim 1, wherein the first mattress comprises a king size mattress and the second mattress comprises a California king size mattress.

8. The expandable fitted bed sheet of claim 1, wherein the first mattress comprises a twin size mattress and the second mattress comprises a twin xl size mattress.

9. The expandable fitted bed sheet of claim 1, wherein the first mattress comprises a full size mattress and the second mattress comprises a queen size mattress.

10. The expandable fitted bed sheet of claim 1, further comprising one or more elastic cords or members, the one or more elastic cords or members mounted to extend around either of the top panel or along edges of the side and end panels, or both.

11. The expandable fitted bed sheet of claim 10, wherein at least one of the elastic members comprises a boxer elastic comprising one selected from the group consisting of a braided elastic, a knit elastic or a woven elastic.

12. The expandable fitted bed sheet of claim 1, wherein the first mattress comprises a twin size mattress comprising a length of about 74 inches, a width of about 39 inches, and a depth of about 14 inches, and wherein the second mattress comprises a twin xl size mattress comprising a length of about 80 inches, a width of about 39 inches, and a depth of about 14 inches.

13. The expandable fitted bed sheet of claim 1, wherein the first mattress comprises a full size mattress comprising a length of about 75 inches, a width of about 54 inches, and a depth of about 14 inches, and wherein the second mattress comprises a queen size mattress comprising a length of about 80 inches, a width of about 60 inches, and a depth of about 16 inches.

14. The expandable fitted bed sheet of claim 1, wherein the first mattress comprises a king size mattress comprising a length of about 80 inches, a width of about 78 inches, and a depth of about 16 inches, and wherein the second mattress comprises a California king size mattress comprising a length of about 84 inches, a width of about 72 inches, and a depth of about 16 inches.

* * * * *